US009096371B2

(12) United States Patent
Allsop

(10) Patent No.: US 9,096,371 B2
(45) Date of Patent: Aug. 4, 2015

(54) METERING VALVE AND DISPENSING APPARATUS

(75) Inventor: Paul Allsop, Norfolk (GB)

(73) Assignee: CONSORT MEDICAL PLC, Hertfordshire (GB)

( * ) Notice: Subject to any disclaimer, the term of this patent is extended or adjusted under 35 U.S.C. 154(b) by 1092 days.

(21) Appl. No.: 12/515,771

(22) PCT Filed: Nov. 7, 2007

(86) PCT No.: PCT/GB2007/004241

§ 371 (c)(1),
(2), (4) Date: May 21, 2009

(87) PCT Pub. No.: WO2008/071901

PCT Pub. Date: Jun. 19, 2008

(65) Prior Publication Data

US 2010/0051651 A1 Mar. 4, 2010

(30) Foreign Application Priority Data

Dec. 13, 2006 (GB) ..... 0624884.3

(51) Int. Cl.
*B65D 83/54* (2006.01)
*B65D 83/42* (2006.01)

(52) U.S. Cl.
CPC ..... *B65D 83/54* (2013.01); *B65D 83/425* (2013.01)

(58) Field of Classification Search
CPC ..... B65D 83/546; B65D 83/54; B65D 83/426
USPC ..... 222/402.1, 402.2, 402.24, 402.25, 425
See application file for complete search history.

(56) References Cited

U.S. PATENT DOCUMENTS

| | | | | |
|---|---|---|---|---|
| 4,744,495 | A | 5/1988 | Warby | |
| 7,793,807 | B2 * | 9/2010 | Goujon et al. | 222/402.2 |
| 2003/0180228 | A1 | 9/2003 | Cripps et al. | |
| 2009/0065533 | A1 * | 3/2009 | Warby et al. | 222/402.2 |

FOREIGN PATENT DOCUMENTS

| | | | |
|---|---|---|---|
| CH | 639 913 | A5 | 12/1983 |
| GB | 2 216 872 | A | 10/1989 |
| WO | 01/89616 | A | 11/2001 |

OTHER PUBLICATIONS

International Search Report for PCT/GB2007/004241 dated Feb. 8, 2008 and Search Report under Section 17 for GB0624884.3 dated Apr. 27, 2007.

* cited by examiner

*Primary Examiner* — Jason Boeckmann
(74) *Attorney, Agent, or Firm* — Smith, Gambrell & Russell, LLP

(57) ABSTRACT

A metering valve (10) for dispensing metered doses of a pressurized product derived from a bulk supply of a pressurized product, the metering valve comprising a valve body (14), a valve stem (11), and sealing means (17,18), the valve stem (11) comprising an outlet for the pressurized product, the valve body (14) defining an internal volume (33), the metering valve further comprising a metering chamber (12), the valve stem being movable between a non-dispensing position in which the metering chamber is, in use, in fluid communication with the bulk supply of pressurized product and a dispensing position in which the metering chamber is in fluid communication with the outlet, characterized in that, in use, the bulk supply of pressurized product is wholly contained within the internal volume (33) of the valve body (14).

21 Claims, 3 Drawing Sheets

METERING VALVE AND DISPENSING APPARATUS

The invention relates to improvements in metering valves and dispensing apparatus for use with pressurised products.

Dispensing apparatus comprising metering valves are used for dispensing a wide variety of products from mobile to viscous liquid products, powder products and the like and typically employ a liquid propellant such as a hydro-carbon or fluoro-carbon having sufficiently high vapour pressure at normal working temperatures to propel the product through the valve. They are commonly used for dispensing pharmaceutical medicaments, cosmetics and similar products.

Conventional valves for use in such apparatus typically comprise a valve stem which is coaxially slidable within an annular metering chamber. The metering chamber itself is defined by or contained within a valve body. Inner and outer annular seals are provided within the valve body extending into co-operating sliding sealing engagement with the valve stem. The valve stem is generally movable against the action of a spring from a non-dispensing position to a dispensing position. In the non-dispensing position ports within the valve stem or other openings allow the metering chamber to be in fluid communication with a bulk supply of product held within a dispensing container to which the valve stem is affixed. In a dispensing position the metering chamber is isolated from the bulk supply of product within the container and is vented to atmosphere via an outlet of the valve stem in order to discharge the product where it may be applied or inhaled etc.

In the prior art dispensing apparatus described above, the valve body acts to provide physical support to the valve stem, chamber body, spring and inner and outer annular seals as well as helping to define a flow path for the product contained within the dispensing apparatus' container. In order to allow flow of product from the container to the metering chamber, the valve body is provided with one or more apertures, slots or openings.

There is a need to provide dispensing apparatus incorporating metering valves for dispensing metered doses of product where the bulk volume of product contained within the dispensing apparatus is relatively low. Examples of where this is desired is where the product is particularly expensive or where the product is of a type where, for safety reasons, it is desired only to provide users of the apparatus with a relatively small quantity of product to prevent accidental or deliberate misuse. For example, there is a desire to provide a dispensing apparatus allowing as little as 10 metered doses to be dispensed where each metered dose has a volume from approximately 25 to 63 microliters.

According to the present invention there is provided a metering valve for dispensing metered doses of a pressurised product derived from a bulk supply of pressurised product, the metering valve comprising a valve body, a valve stem, and sealing means, the valve stem comprising an outlet for the pressurised product, the valve body defining an internal volume, the metering valve further comprising a metering chamber, the valve stem being movable between a non-dispensing position in which the metering chamber is, in use, in fluid communication with the bulk supply of pressurised product and a dispensing position in which the metering chamber is in fluid communication with the outlet, characterised in that, in use, the bulk supply of pressurised product is wholly contained within the internal volume of the valve body.

Advantageously, the internal volume of the valve body can be easily and precisely controlled. In addition, using the internal volume of the valve body to store the bulk supply of product is particularly appropriate where the overall volume of the bulk supply is relatively small. A particular advantage is that the metering valve can have a very small or zero degree of ullage (ullage representing the volume of product which is not dispensable from an apparatus due to the physical geometry of the valve—in particular the relative positioning of the ports and storage volumes of the valve). In prior art valves where the bulk supply of product is held outside the valve body, ullage is often caused by the difficulty of inability in positioning ports or openings in the valve body at or near the outlet end of the dispensing apparatus. Thus, with the apparatus inverted, there will exist a quantity of product located below the level of the opening between the pressurised dispensing container and the inside of the valve body. In the present invention this ullage is avoided since the dispensable product is already located in the inside of the valve body.

Another advantage is that the metering valve exhibits a sharp tail-off characteristic as it reaches an empty state. In other words the valve is not as prone to the problem whereby the quantity of product dispensed in each dose towards the end of the apparatus' life decreases compared to previous doses. For example, a valve designed to dispense 63 microliters in each normal dose may dispense two or three doses with only 20 or 30 microliters as it nears empty. This phenomenon is caused in part where ullage in the valve is shaken into the metering chamber but is insufficient to properly fill the metering chamber to achieve a full dose. In the valve of the present invention since there is very little or even zero ullage present the valve is less prone to this tail-off in dosage volume as it nears an empty state. This makes the valve particularly suitable for apparatus containing a relatively small number of total doses.

Preferably the internal volume of the valve body defines a first volume containing the metering chamber and a second volume forming a bulk product storage volume.

Preferably the first volume and second volume are sealed from one another in the dispensing position of the metering valve by the sealing means. Advantageously, the design of the valve body can be simple and formed from a single moulding.

Advantageously the internal volume of the valve body is a closed volume when the metering valve is in the non-dispensing position.

Preferably, a chamber body is provided within the internal volume of the valve body, the chamber body at least in part defining the metering chamber. Use of a chamber body allows for an easy method of controlling the volume of the metering chamber in each valve. For example, a single design of valve body can be fitted with different sizes of chamber body to vary the metered volume dispensed by the valve.

Preferably, the sealing means comprises an inner annular seal and an outer annular seal.

Preferably the inner annular seal seals between the valve stem and the valve body.

Preferably the internal volume of the valve body defines a first volume containing the metering chamber and a second volume forming a bulk product storage volume, and wherein the first volume and second volume are sealed from one another in the dispensing position of the metering valve by the inner annular seal.

Preferably, the outer annular seal seals between the valve stem and the chamber body.

Preferably the bulk product storage volume is sealed from atmosphere by only the inner annular seal and the outer annular seal. Advantageously, the design allows for a simplified construction with only two critical seals between the stored product and atmosphere. Unlike in a conventional valve the sealing gasket between the metering valve and the dispensing container is not a critical seal. The reduced number and surface area of critical seals reduces the problem of unwanted extractables within the product when stored. It also allows for more tolerance in the operation of crimping the metering valve onto a container using a ferrule.

In one version of metering valve the valve stem is axially slidable.

The bulk product storage volume of the valve body may be sufficient to contain up to ten to fifteen 100 microliter doses of product. The aerosol dispensing apparatus is preferably designed to have a useful life of approximately ten doses. Normally the valve will be filled to contain between ten and fifteen doses initially to allow for one or two actuations of the valve to prime the valve ready for use and also to allow for any leakage during storage of the apparatus prior to first use.

The bulk product storage volume may be sized to contain approximately ten to fifteen 63 microliter doses of product. Alternatively, it may be sized to hold approximately ten to fifteen 50 microliter doses or approximately ten to fifteen 25 microliter doses of product. Advantageously, the valve of the present invention allows the efficient storage and dispensation of such small volumes. In a conventional valve such volumes would not be practical due to ullage and the fact that the container body would become inconveniently small.

Whilst the metering valve of the present invention is particularly suitable where it contains a total of ten to fifteen doses of product it may be used with advantage for apparatus containing in the region of 30 doses or more in total. Depending on the total volume of product that is required to be stored in the bulk product storage volume, the length of the valve body may be varied to accommodate the variance in product volume. Also, the inner and outer diameter of the valve body may be varied to accommodate variance in the size of seals used in the metering valve's metering chamber.

Preferably the valve body comprises means for allowing over-filling of the internal volume. In one embodiment the means for allowing over-filling comprises a one-way valve in the valve body. The one-way valve may comprise an aperture in a wall of the valve body and a resilient sleeve overlaying the aperture, wherein, during filling of the metering valve, excess product may pass through the aperture by deforming the resilient sleeve. Alternatively, the one-way valve may comprise an aperture and a resilient plug located in the aperture, wherein, during filling of the metering valve, excess product may pass through the aperture by deforming the resilient plug. Advantageously, the use of a one-way valve allows easier pressure filling of the internal volume of the valve body since a small excess of the total volume of product which has been injected through the valve stem may pass through the one-way valve so as to ensure complete filling of the storage volume of the valve by means of product. In other words, a small excess of product 'over-flows' from the storage volume into the dispensing container. This is advantageous because the standard filling equipment currently used for filling such dispensing apparatus is not capable of injecting precise volumes suitable for low fill-weight applications. Any inaccuracy in injecting a volume into the valve is aggravated where the total number of doses contained in the apparatus is relatively small. The present valve allows the manufacture to inject a small excess volume into the valve thus ensuring that any inaccuracy in the filling head will not affect the total volume of product stored in the valve body. Excess product passing through the one-way valve is not dispensable as it cannot pass back through the one-way valve.

The present invention also provides a metering valve as described above together with a container body.

The container body may be fixed to the metering valve by means of a crimped ferrule. The addition of a container body to the metering valve can be advantageous in improving the ergonomic properties of the valve and allowing the dispensing apparatus to be produced on a conventional filling or manufacturing line without major modifications. It also has the advantage of providing an outer appearance of the apparatus which is familiar to the end user. An additional advantage is that the apparatus may be supplied for filling with product with the container body already affixed to the metering valve. Normally this step needs to be performed during the filling operation.

A further advantage is that the physical integrity of the product stored within the apparatus is increased since there exists a double layer of material between the outside and the storage volume of the valve body. This increases the apparatus' resistance to physical shock and to tampering.

A bulk supply of product may be contained in the internal volume of the valve body.

The valve may be for use in a pharmaceutical dispensing device, such as, for example, a pulmonary, nasal, or sublingual delivery device. A preferred use of the valve is in a pharmaceutical metered dose aerosol inhaler device. The term pharmaceutical as used herein is intended to encompass any pharmaceutical, compound, composition, medicament, agent or product which can be delivered or administered to a human being or animal, for example pharmaceuticals, drugs, biological and medicinal products. Examples include antiallergics, analgesics, antibodies, vaccines, bronchodilators, antihistamines, therapeutic proteins and peptides, antitussives, anginal preparations, antibiotics, anti-inflammatory preparations, hormones, or sulfonamides, such as, for example, a vasoconstrictive amine, an enzyme, an alkaloid, or a steroid, including combinations of two or more thereof. In particular, examples include isoproterenol [alpha-(isopropylaminomethyl) protocatechuyl alcohol], phenylephrine, phenylpropanolamine, glucagon, insulin, DNAse, adrenochrome, trypsin, epinephrine, ephedrine, narcotine, codeine, atropine, heparin, morphine, dihydromorphinone, ergotamine, scopolamine, methapyrilene, cyanocobalamin, terbutaline, rimiterol, salbutamol, flunisolide, colchicine, pirbuterol, beclomethasone, orciprenaline, fentanyl, and diamorphine, streptomycin, penicillin, procaine penicillin, tetracycline, chlorotetracycline and hydroxytetracycline, adrenocorticotropic hormone and adrenocortical hormones, such as cortisone, hydrocortisone, hydrocortisone acetate and prednisolone, insulin, cromolyn sodium, and mometasone, including combinations of two or more thereof.

The pharmaceutical may be used as either the free base or as one or more salts conventional in the art, such as, for example, acetate, benzenesulphonate, benzoate, bicarbonate, bitartrate, bromide, calcium edetate, camsylate, carbonate, chloride, citrate, dihydrochloride, edetate, edisylate, estolate, esylate, fumarate, fluceptate, gluconate, glutamate, glycollylarsanilate, hexylresorcinate, hydrobromide, hydrochloride, hydroxynaphthoate, iodide, isethionate, lactate, lactobionate, malate, maleate, mandelate, mesylate, methylbromide, methylnitrate, methylsulphate, mucate, napsylate, nitrate, pamoate, (embonate), pantothenate, phosphate, diphosphate, polygalacturonate, salicylate, stearate, subacetate, succinate, sulphate, tannate, tartrate, and triethiodide, including combinations of two or more thereof. Cationic salts may also be used, for example the alkali metals, e.g. Na and K, and ammonium salts and salts of amines known in the art to be pharmaceutically acceptable, for example glycine, ethylene diamine, choline, diethanolamine, triethanolamine, octadecylamine, diethylamine, triethylamine, 1-amino-2-propanol-amino-2-(hydroxymethyl)propane-1,3-diol, and 1-(3,4-dihydroxyphenyl)-2 isopropylaminoethanol.

The pharmaceutical will typically be one which is suitable for inhalation and may be provided in any suitable form for this purpose, for example as a solution or powder suspension in a solvent or carrier liquid, for example ethanol, or isopropyl alcohol. Typical propellants are HFA134a, HFA227 and dimethyl ether.

The pharmaceutical may, for example, be one which is suitable for the treatment of asthma. Examples include salbutamol, beclomethasone, salmeterol, fluticasone, formoterol, terbutaline, sodium chromoglycate, budesonide and flunisolide, and physiologically acceptable salts (for example salbutamol sulphate, salmeterol xinafoate, fluticasone propionate, beclomethasone dipropionate, and terbutaline sulphate), solvates and esters, including combinations of two or more thereof. Individual isomers such as, for example, R-salbutamol, may also be used. As will be appreciated, the pharmaceutical may comprise of one or more active ingredients, an example of which is flutiform, and may optionally be provided together with a suitable carrier, for example a liquid carrier. One or more surfactants may be included if desired.

The seals and gaskets (if present for connecting the valve to a container) of the valve may be formed from any suitable material having acceptable performance characteristics. Preferred examples include nitrile, EPDM and other thermoplastic elastomers, butyl and neoprene.

Other rigid components of the valve, such as the valve body, chamber body and valve stem may be formed, for example, from polyester, nylon, acetal or similar. Alternative materials for the rigid components of the valve include stainless steel, ceramics and glass.

The container body may be of any known type including a cut-edge canister, roll-neck canister or glass bottle.

Embodiments of the present invention will now be described, by way of example only, with reference to the accompanying drawings in which.

Figure 1:
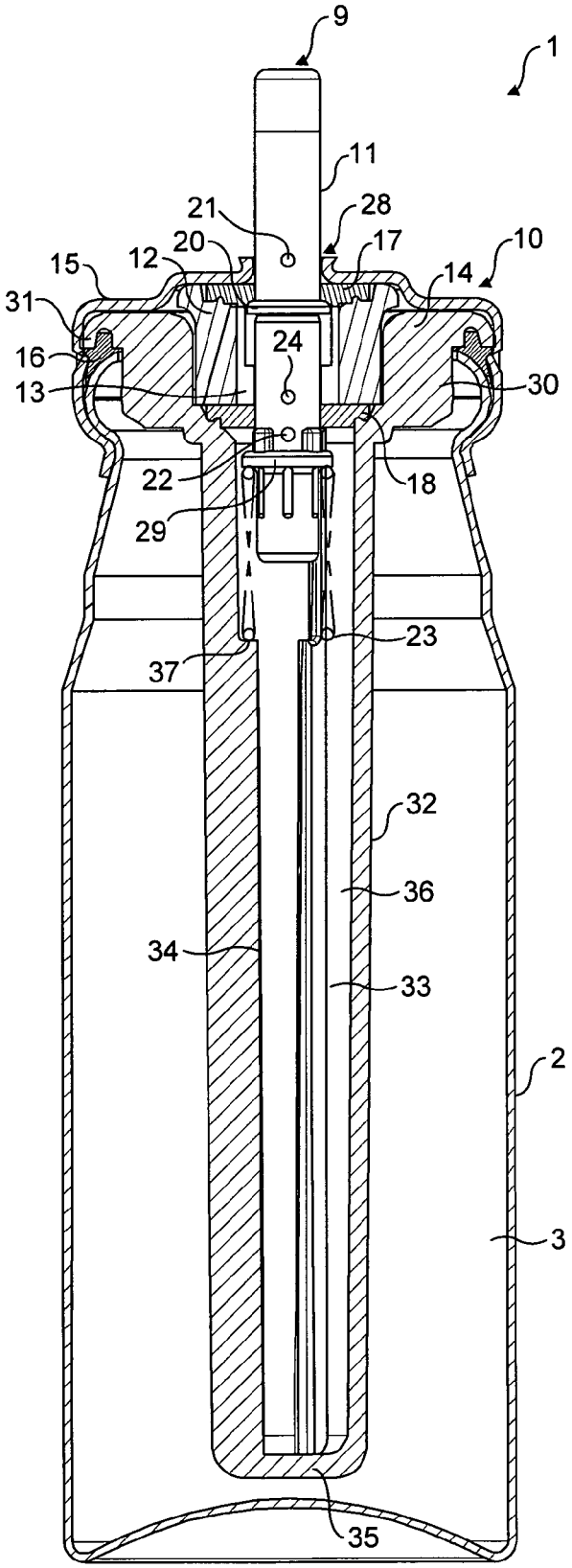
FIG. 1 is a cross-sectional view of a first embodiment of dispensing apparatus according to the present invention.

As shown in FIG. 1, the first embodiment of dispensing apparatus 1 includes a metering valve 10 connected to a dispensing container 2 by means of a crimped ferrule 15. The valve 10 comprises a valve stem 11 which protrudes from and is axially slidable within a valve body 14. The valve body 14 comprises an elongate structure having an upper end 30 and a lower end 32. The upper end 30 is engaged with the dispensing container 2 by confinement of a flange 31 of the valve body 14 between the ferrule 15 and an upper rim of the dispensing container 2. As shown, a gasket 16 may be provided between the upper rim of the dispensing container 2 and the flange 31 of the valve body 14.

The valve body 14 defines an internal volume 33 which contains the valve stem 11 as well as a metering chamber body 12, inner seal 18, outer seal 17 and spring 23.

The metering chamber body 12 is provided within the internal volume 33 of the valve body 14 at the upper end 30 of the valve body 14.

The inner and outer seals 18, 17 are formed of an elastomeric material and extend radially between the valve stem 11 and the metering chamber body 12 and/or the valve body 14. The outer seal 17 is radially compressed between the metering chamber body 12, valve stem 11 and ferrule 15 so as to provide positive sealing contact to prevent leakage from the metering chamber 13 between the valve stem 11 and the ferrule 15 at point 28. The inner seal 18 is located between the metering chamber body 12, valve body 14 and valve stem 11 in order to seal an inner end of the metering chamber 13.

The outer end of the valve stem 11 which protrudes from the ferrule 15 comprises the discharge end of the valve stem and defines an outlet 9. A discharge port 21 is provided which extends radially through the side wall of the valve stem 11. The valve stem 11 further comprises a radially extending flange 20 which is located within the metering chamber 13. In addition, two transfer ports 22, 24 are provided which extend radially through the side wall of the valve stem 11 and are connected together internally within the valve stem 11, the use of which will be discussed below. A further radially extending flange 29 is provided towards an inner end of the valve stem 11 located within the internal volume 33 of the valve body 14 below the position of the inner seal 18.

The inner end 32 of the valve body 14 is formed as an elongate, hollow member with a closed end 35. A plurality of longitudinal ribs 34 are provided extending inwardly from an inner surface of the side wall of the valve body 14 which define at their uppermost extremity a ledge 37 against which the spring 23 can sit.

The valve body 14 may be formed as a single moulding.

The spring 23 extends from an under surface of the radial flange 29 into contact with the ledge 37 of the valve body 14.

The internal volume 33 of the valve body 14 incorporates the volume of the metering chamber 13 (and chamber body where present) and a bulk product supply volume 36. The inner seal 18 separates the metering chamber 13 from the bulk product supply volume 36 such that transfer of fluid between the volumes is only possible via the transfer ports 22, 24 of the valve stem 11 as described below.

In the first embodiment as illustrated, the valve body 14 when assembled with the other components of the dispensing apparatus defines a closed volume—in other words, there is no transfer of fluid from between the internal volume 33 of the valve body 14 and an internal volume 3 of the dispensing container 2. This has the effect that all product which is dispensed from the metering valve 10 is derived from the internal volume 33 of the valve body 14 and not from the internal volume 3 of the dispensing container 2.

In use, to actuate the dispensing apparatus, the valve stem 11 is depressed relative to the valve body 14 such that the valve stem 11 slides axially relative to the metering chamber body 12. Upon depression of the valve stem 11 the outer transfer port 24 moves relative to the inner seal 18 and is closed off by the inner seal 18 thereby isolating the metering chamber 13 from the contents of the valve body's 14 bulk product supply volume 36. Upon further movement of the valve stem 11 in the same direction into the dispensing position the discharge port 21 passes through the outer seal 17 into communication with the metering chamber 13. In this dispensing position, the liquefied product in the metering chamber 13 rapidly boils off and is discharged to atmosphere via the discharge port 21 and outlet 9.

When the valve stem 11 is released, the bias of the spring 23 causes the valve stem 11 to return to its original, non-dispensing position. As the valve stem 11 returns to the non-dispensing position, the outer transfer port 24 passes back into communication with the metering chamber 13 allowing re-filling of the metering chamber 13 from product stored in the bulk product supply volume 36 of the valve body 14 via the transfer ports 22 and 24.

Figure 2:
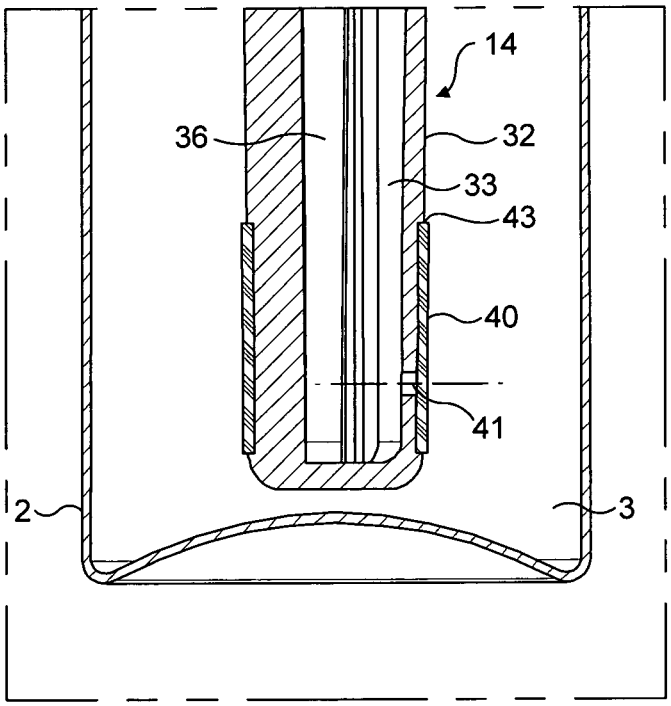
FIG. 2 is a cross-sectional view of a detail of a second embodiment of dispensing apparatus according to the present invention.

FIG. 2 illustrates a second embodiment of dispensing apparatus according to the present invention. The components for the second embodiment are largely identical to those of the first embodiment and will not be described further here and reference is made to the description above. In the second embodiment, the valve body 14 is provided with an aperture 41 which passes through a side wall of the elongate section 32 of the valve body 14. A resilient sleeve 40 is located in a position to overlay the aperture 41 and is retained in position within a circumferential recess 43 formed on the outer surface of the valve body 14. The resilient sleeve 40 is formed from a material such as an elastomer having elastic properties. The resilient sleeve 40 and aperture 41 together define a one-way valve which allows the potential for product within the internal volume 33 of the valve body 14 to pass into the internal volume 3 of the dispensing container 2 during filling of the dispensing apparatus via the valve stem 11. During filling, pressurised product is injected into the dispensing apparatus via the valve stem 11 with the valve stem 11 held in the dispensing position. The pressurised product flows via the discharge port 21 into the metering chamber 13 and then passes into the bulk product storage volume 36 of the valve body 14 by means of deflecting inwardly the inner seal 18 to allow bypass flow. If a greater volume of pressurised product is filled into the bulk product storage volume 36 of the valve body 14 than can be contained within the bulk product storage volume 36 then the excess will pass into the internal volume 3 of the dispensing container 2 by deforming the resilient sleeve 40 allowing flow of fluid via the aperture 41 which then passes between the resilient sleeve 40 and the outer surface of the valve body 14 into the internal volume 3 of the dispensing container 2. Once pressure filling has finished, the resilient nature of the resilient sleeve 40 reseals the one-way valve preventing backflow of product from the internal volume 3 of the dispensing container 2. It should be noted that during dispensation of metered doses from the dispensing apparatus, no product contained within the internal volume 3 of the dispensing container 2 is dispensed. As in the first embodiment, the entire product that is dispensable from the apparatus is derived from the bulk product storage volume 36 of the valve body 14.

Figure 3:
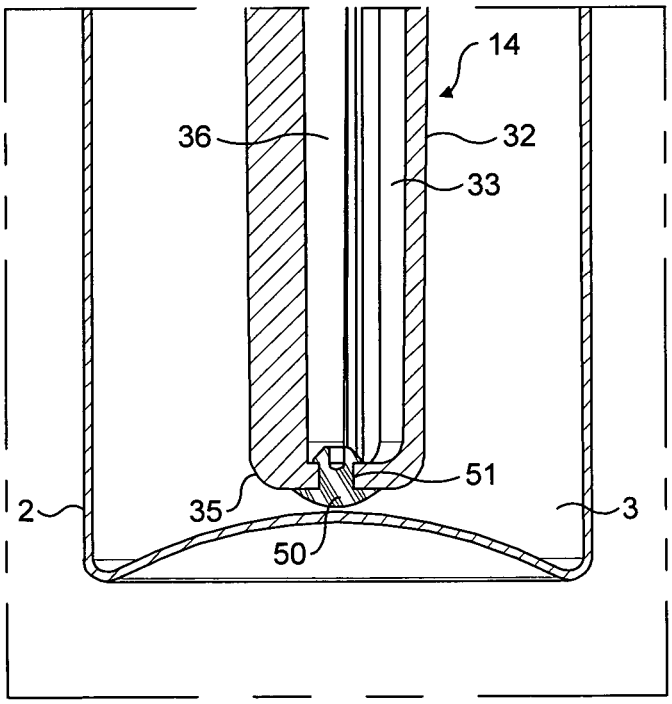
FIG. 3 is a cross-sectional view of a detail of a third embodiment of dispensing apparatus according to the present invention.

FIG. 3 shows a third embodiment according to the present invention. As in the second embodiment, the majority of the components are as described in the first embodiment and will not be described further. The third embodiment describes an alternative design of one-way valve to be used during the pressure filling of the dispensing apparatus. In this embodiment, an aperture 51 is provided in the end wall 35 of the valve body 14 and a resilient plug 50 is located therein. During pressure filling of the valve body 14, excess product may pass into the internal volume 3 of the dispensing container by deforming the resilient plug 50 allowing bypass of product through the aperture 51. As in the second embodiment, when pressure filling is finished the resilient plug 51 reseals the one-way valve preventing backflow of any product from the internal volume 3 of the dispensing container 2 into the internal volume 33 of the valve body 14.

Figure 4:
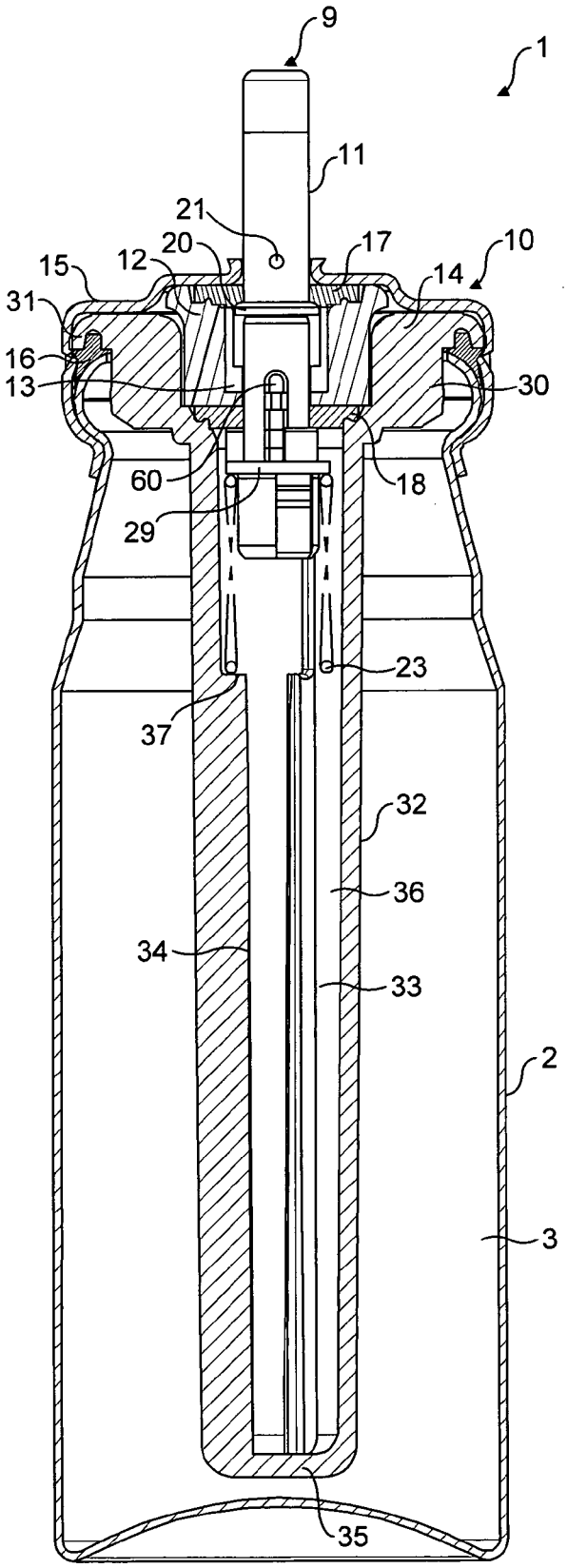
FIG. 4 is a cross-sectional view of a fourth embodiment of dispensing apparatus according to the present invention.

FIG. 4 shows a fourth embodiment of dispensing apparatus according to the present invention. Like components to those described in the first embodiment will not be described in detail. Reference is made to the description above. The fourth embodiment differs from the first embodiment in the design of the valve stem 11. In this embodiment, the valve stem 11 is provided with a discharge port 21 as in the first embodiment but the transfer ports 22 and 24 are replaced by elongated slots 60 in the side wall of the valve stem 11. The slots 60 are orientated along the longitudinal axis of the valve stem 11 and extend from the radially extending flange 29 outwardly partway towards the radially extending flange 20. The slots 60 extend radially through the thickness of the wall of the valve stem 11 allowing fluid communication between a central passage of the valve stem 11 and an outside of the valve stem 11. In the non-dispensing position as shown in FIG. 4, the length of the elongated slots 60 bridge the inner seal 18 allowing fluid communication between the metering chamber 13 and the bulk product supply volume 36 of the valve body 14.

In use, as in the first embodiment, the dispensing apparatus is actuated by depression of the valve stem 11. Inward movement of the valve stem 11 moves the elongated slot 60 past the inner seal 18 to a position where the metering chamber 13 is isolated from the bulk supply of product contained within the volume 36 of the valve body 14. At the same time, as in the first embodiment, the discharge port 21 is moved past the outer seal 17 into communication with the metering chamber to allow discharge of the product within the metering chamber 13. On release of the valve stem 11 the valve stem 11 returns to the non-dispensing position under action of the spring 23 bringing the elongated slots 60 back into the position shown in FIG. 4 where they bridge the inner seal 18. A functional difference between the valve stems of the first and fourth embodiments is that in the fourth embodiment the metering chamber 13 can freely drain when the valve is in the non-dispensing position via the elongated slots 60 whilst in the design of the first embodiment the product in the metering chamber 13 is retained by capillary action.

The invention claimed is:

1. A metering-valve for dispensing metered doses of a pressurised product derived from a bulk supply of pressurised product, the metering valve comprising a valve body, a valve stem, and sealing means, the valve stem comprising an outlet for the pressurised product, the valve body being formed from a single element defining an internal volume, the metering valve further comprising a metering chamber, the valve stem being movable between a non-dispensing position in which the metering chamber is, in use, in fluid communication with the bulk supply of pressurised product and a dispensing position in which the metering chamber is in fluid communication with the outlet, wherein, in use, the bulk supply of pressurised product is wholly contained within the internal volume of the valve body; and wherein, in dispensing use, throughout a dispensing-life of the metering-valve, no pressurised product is transferred into the internal volume of the valve body from outside the valve body.

2. A metering valve as claimed in claim 1 wherein the internal volume of the valve body defines a first volume containing the metering chamber and a second volume forming a bulk product storage volume.

3. A metering valve as claimed in claim 2 wherein the first volume and second volume are sealed from one another in the dispensing position of the metering valve by the sealing means.

4. A metering valve as claimed in claim 1 wherein the metering chamber is formed as a part of the internal volume of the valve body.

5. A metering valve as claimed in claim 1 wherein a chamber body is provided within the internal volume of the valve body, the chamber body at least in part defining the metering chamber.

6. A metering valve as claimed in claim 1 wherein the sealing means comprises an inner annular seal and an outer annular seal.

7. A metering valve as claimed in claim 5 wherein the sealing means comprises an inner annular seal which provides a seal between the valve stem and the valve body.

8. A metering valve as claimed in claim 7 wherein the internal volume of the valve body defines a first volume containing the metering chamber and a second volume forming a bulk product storage volume, and wherein the first volume and second volume are sealed from one another in the dispensing position of the metering valve by the inner annular seal.

9. A metering valve as claimed in claim 1 wherein a chamber body is provided within the internal volume of the valve body, the chamber body at least in part defining the metering chamber, wherein the sealing means comprises an inner annular seal and an outer annular seal, and wherein the outer annular seal seals between the valve stem and the chamber body.

10. A metering valve as claimed in claim 6 wherein a bulk product storage volume is sealed from atmosphere by only the inner annular seal and the outer annular seal.

11. A metering valve as claimed in claim 1 in which the valve stem is axially slidable.

12. A metering valve as claim 1 wherein a bulk product storage volume of the valve body is sufficient to contain up to fifteen doses of up to 100 microliter of product.

13. A metering valve as claimed in claim 12 wherein the bulk product storage volume is sized to contain approximately ten to fifteen 63 microliter doses of product.

14. A metering valve as claimed in claim 12 wherein the bulk product storage volume is sized to contain approximately ten to fifteen 50 microliter doses of product.

15. A metering valve as claimed in claim 12 wherein the bulk product storage volume sized to contain approximately ten to fifteen 25 microliter doses of product.

16. A dispensing apparatus comprising a metering valve as claimed in claim 1 together with a container body.

17. A dispensing apparatus as claimed in claim 16 wherein the container body is fixed to the metering valve by means of a crimped ferrule.

18. A dispensing apparatus as claimed in claim 16 further comprising a bulk supply of product contained in the internal volume of the valve body.

19. A metering-valve for dispensing metered doses of a pressurised product derived from a bulk supply of pressurised product, the metering valve comprising a valve body, a valve stem, and sealing means, the valve stem comprising an outlet for the pressurised product, the valve body being formed from a single element defining an internal volume, the metering valve further comprising a metering chamber, the valve stem being movable between a non-dispensing position in which the metering chamber is, in use, in fluid communication with the bulk supply of pressurised product and a dispensing position in which the metering chamber is in fluid communication with the outlet, wherein, in use, the bulk supply of pressurised product is wholly contained within the internal volume of the valve body, and wherein the internal volume of the valve body is a closed volume when the metering valve is in the non-dispensing position.

20. A metering-valve for dispensing metered doses of a pressurised product derived from a bulk supply of pressurised product, the metering valve comprising a valve body, a valve stem, and sealing means, the valve stem comprising an outlet for the pressurised product, the valve body being formed from a single element defining an internal volume, the metering valve further comprising a metering chamber, the valve stem being movable between a non-dispensing position in which the metering chamber is, in use, in fluid communication with the bulk supply of pressurised product and a dispensing position in which the metering chamber is in fluid communication with the outlet, wherein, in use, the bulk supply of pressurised product is wholly contained within the internal volume of the valve body; and wherein, in dispensing use, over an initial and subsequent plurality of metered dose dispensations, no pressurised product is transferred into the internal volume of the valve body from outside the valve body.

21. A dispensing apparatus as claimed in claim 16 further comprising a ferrule for receiving the container.

* * * * *